United States Patent [19]

Taylor

[11] 4,444,213

[45] Apr. 24, 1984

[54] NON-ELECTRIC PORTABLE DISHWASHER

[76] Inventor: Frank J. P. Taylor, 4120 Birsh St., Ste. 105, Newport Beach, Calif. 92660

[21] Appl. No.: 441,384

[22] Filed: Nov. 12, 1982

Related U.S. Application Data

[63] Continuation-in-part of Ser. No. 205,710, Nov. 13, 1982, Pat. No. 4,368,747.

[51] Int. Cl.[3] ..... B08B 3/02

[52] U.S. Cl. ..... 134/56 D; 134/93; 134/138; 134/155; 134/200

[58] Field of Search ..... 134/56 D, 93, 100–101, 134/138–139, 141, 153–155, 186, 190, 200

[56] References Cited

U.S. PATENT DOCUMENTS

| | | | |
|---|---|---|---|
| 2,567,820 | 9/1951 | Messerschmidt | 134/138 |
| 3,203,436 | 8/1965 | Wallgren et al. | 134/93 X |
| 4,368,747 | 1/1983 | Taylor | 134/93 |

FOREIGN PATENT DOCUMENTS

| | | | |
|---|---|---|---|
| 1503825 | 10/1969 | Fed. Rep. of Germany | 134/56 D |

*Primary Examiner*—Robert L. Bleutge

*Attorney, Agent, or Firm*—James E. Brunton

[57] ABSTRACT

An improved rotatable dishwasher adapted to be connected to a domestic water supply line including a housing, a rack rotatably mounted within the housing, the rack being adapted to support articles to be washed, a water jet subassembly including a control mechanism for directing a jet of water in the direction of the rack to impart rotational movement thereto, the jet subassembly comprising a first collimated jet for emitting a collimated stream of water in the direction of the rack for initiating rotation thereof and a second spray jet for sustaining rotation of the rack, and safety valving interposed between the unit and the domestic water supply for positively preventing any flow of fluid from the dishwasher in a direction toward the domestic water supply line.

12 Claims, 13 Drawing Figures

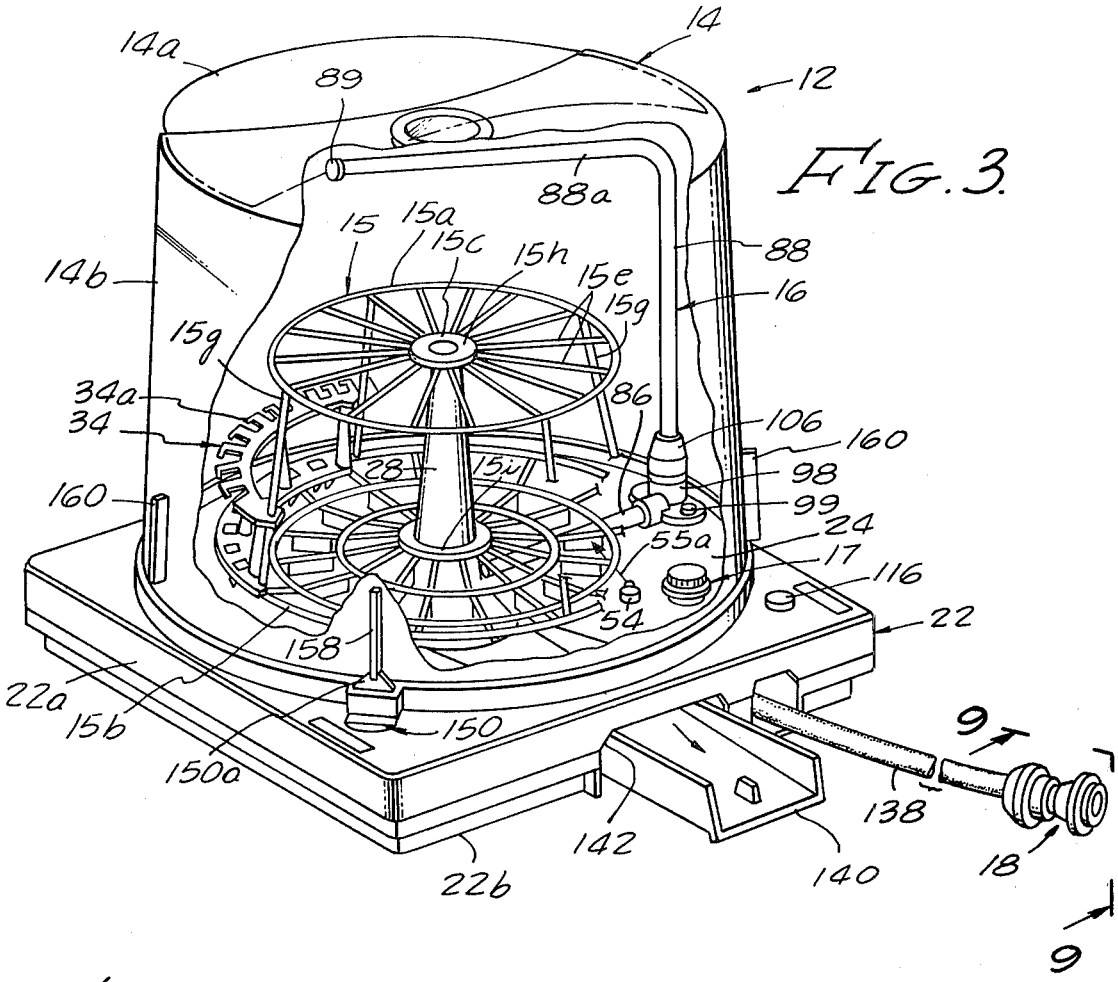
FIG. 3.
FIG. 9.
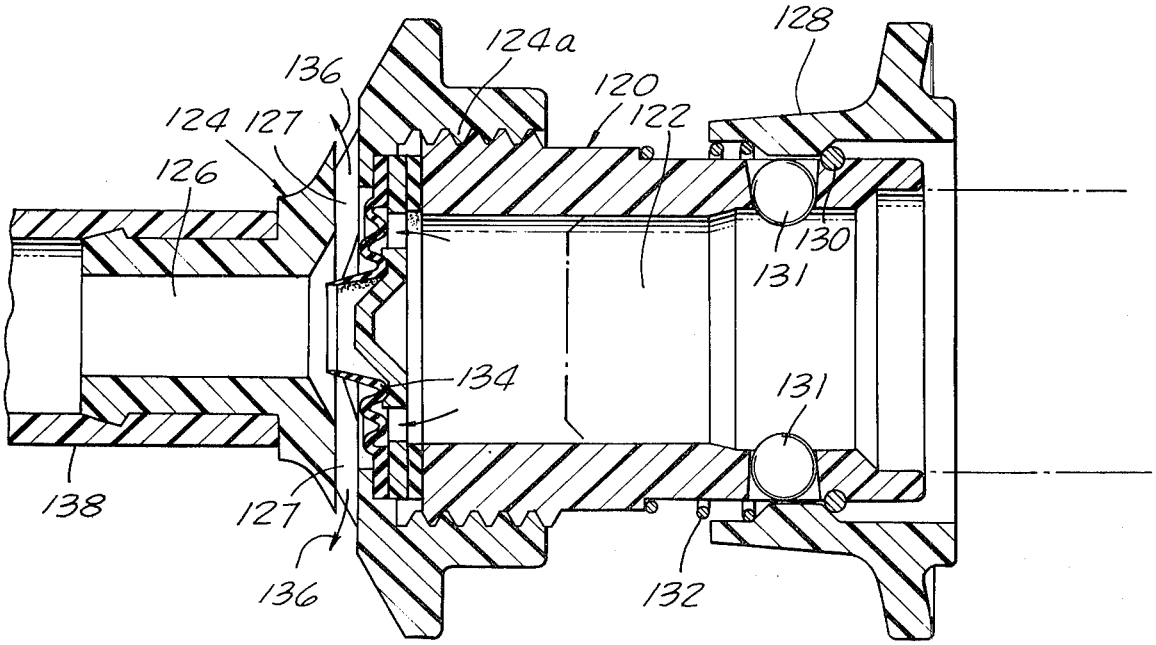

NON-ELECTRIC PORTABLE DISHWASHER

BACKGROUND OF THE INVENTION

1. Field of the Invention

The present invention relates generally to dishwashers and more particularly to a non-electric, self-contained, portable dishwasher unit adapted to be removably interconnected with a domestic hot water supply.

2. Discussion of the Prior Art

Portable dishwashers operable solely by water pressure are not new. Several such units have been manufactured and sold in recent years. A common drawback of such units, however, has been their inability to rapidly and effectively clean dishes and cookware.

Many of the prior art units are cheaply constructed and have been sold more as a novelty item than as a bona fide, high performance dishwashing device. Generally, the washing action in such units is attempted by one or more rapidly rotating emitters located beneath or along side a rack holding the dishes. These emitters, which operate in much the same manner as lawn sprinklers, have proven ineffective in the removal of most troublesome types of food residue on the dishes. Other types of emitters have from time to time been tried, but for the most part have also proven to be ineffective.

One of the most effective dishwasher units ever developed is the unit discussed in my co-pending application Ser. No. 205,710, now U.S. Pat. No. 4,368,747. This unit, for the first time, overcomes the quality and performance drawbacks inherent in its predecessor prior art devices. Like the apparatus of my earlier design, the present invention is not a toy, or a novelty item, but rather is a carefully engineered, high performance device adapted to rapidly and efficiently remove even the most difficult food residue from dishes and cookware. The improved and readily adjustable water jet means of this new improved unit controllably directs a multiplicity of high velocity water jets at the articles to be washed while they are supported within the unit on a unique holding rack which is precisely rotated at an optimum rate of speed. These water jets may be directed to impinge upon all the surfaces of the dishes supported within the rotating rack and create a unique scrubbing type of action which loosens and dislodges even the most difficult of residues. A dosing chamber of improved design precisely mixes an emulsifier, such as liquid soap, with the water upstream of the water jets thereby enhancing the cleaning efficiency of the device.

An important aspect of the present invention is the improved water jet means and the control means associated therewith. The water jet means comprises a first collimated jet means adapted to initiate rotation of the rotatable rack which supports the dirty dishes, and an adjustable second spray jet means which accomplishes the efficient scrubbing and cleansing action and sustains the rotation of the rack. The control means which are associated with the jet means permit a smooth transition between the activation of the first and second jet means to obtain efficient initiation of rotation followed by maximum cleaning effectiveness. The spray jet means is readily adjustable with respect to the rack so that a multiplicity of fine, very high velocity water jets bombard the dishes from all angles, from above, from below and from the sides. The unique hole pattern formed in the spray jet means permits optimum controlled rotation of the supporting rack while at the same time accomplishing maximum cleaning and scrubbing of the dishes.

Another important aspect of the present invention reside in the novel apparatus embodied in the dishwasher unit for preventing any possible back flow of fluid from the dishwasher unit into the domestic water supply should the pressure within the device for any reason exceed the input pressure of the domestic water supply.

SUMMARY OF THE INVENTION

It is an object of the present invention to provide an improved non-electric free standing, self-contained rotatable dishwasher for washing dishes, cookware and the like which is operated solely by domestic water pressure and can be directly connected to a hot water faucet of the type typically provided in kitchens and bathrooms of houses and apartments.

It is another object of the invention to provide a dishwasher of the aforementioned character in which, in operation, a multiplicity of very fine high velocity jets of water are directed at the articles to be washed from a multiplicity of directions, said jets being of such force as to quickly and efficiently dislodge and thoroughly clean even the most stubborn of food residues and greases.

It is another object of the invention to provide a dishwasher of the character described in which means are provided for uniformly and controllably mixing a soap or detergent with the high velocity water jets. This novel means is adapted to precisely meter the emulsifier into the water stream so as to economically use only the minimum amount of emulsifier necessary to effectively clean the dishes.

Still another object of the invention is to provide a dishwasher of the type described in the preceeding paragraphs in which the articles to be washed are strategically held in position upon a uniquely configured improved rotating rack adapted to orient the articles with respect to the high velocity water jets so as to achieve a novel scrubbing type of action to enable maximum cleaning in a minimum time.

Another object of the invention is to provide a dishwasher as described in the previous paragraph in which, during the start-up mode, a first collimated water jet is directed at the rotatable rack to initiate rotation. Once the starting inertia of the rack is overcome, the first water jet is closed, and the full force of the water is directed toward a jet spray system which sustains the rotation of the rack and at the same time effectively accomplishes the washing operation. The novel control mechanism of the invention permits a smooth transition between the starting and scrubbing mode and is easily operated from the exterior of the unit.

A further object of the invention is to provide an improved dishwasher of the class described which is compact, light weight, easily portable, highly attractive and extremely simple to use and maintain.

Another object of the invention is to provide a dishwasher of the aforementioned character which can be readily interconnected to domestic water outlets without the use of special tools and which includes drain means for conveniently draining the unit into an existing kitchen or bathroom sink.

Still another object of the invention is to provide an improved dishwasher of the class described in which there is provided a safety device adapted to preclude any backflow of fluid from the unit into the domestic water supply.

These and other objects of the invention are realized by an improved rotatable dishwsher adapted to be connected to a domestic water supply line comprising a housing, a rack rotatably mounted within the housing, the rack being adapted to support articles to be washed, jet means for directing a jet of water in the direction of said rack to impart rotational movement thereto, the jet means comprising a first collimated jet for emitting a collimated stream of water in the direction of the rack for initiating rotation thereof and a second spray jet for sustaining rotaion of said rack, and safety means interposed between the unit and the domestic water supply for positively preventing flow of fluid from the dishwasher in a direction toward the domestic water supply line.

BRIEF DESCRIPTION OF THE DRAWINGS

FIG. 3 is a generally perspective view of the dishwasher generally designated by numeral 12.

FIG. 9 is a cross-sectional view of the fluid control safety means of the invention taken along lines 9—9 of FIG. 3.

DESCRIPTION OF ONE FORM OF THE INVENTION

Figure 1:
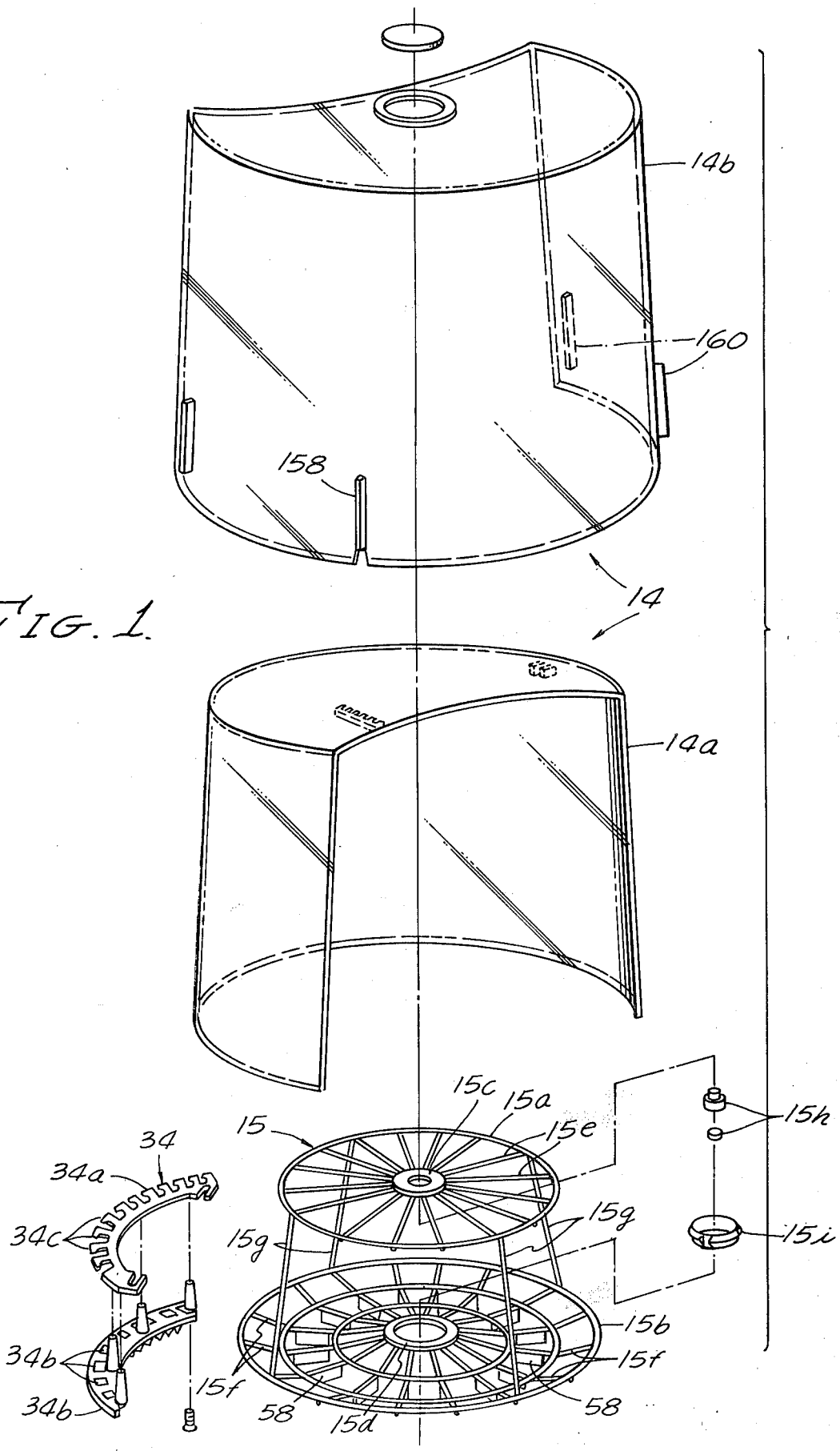
FIG. 1 is an exploded generally perspective view of the outer housing and article supporting racks of the apparatus of the invention.
Figure 2:
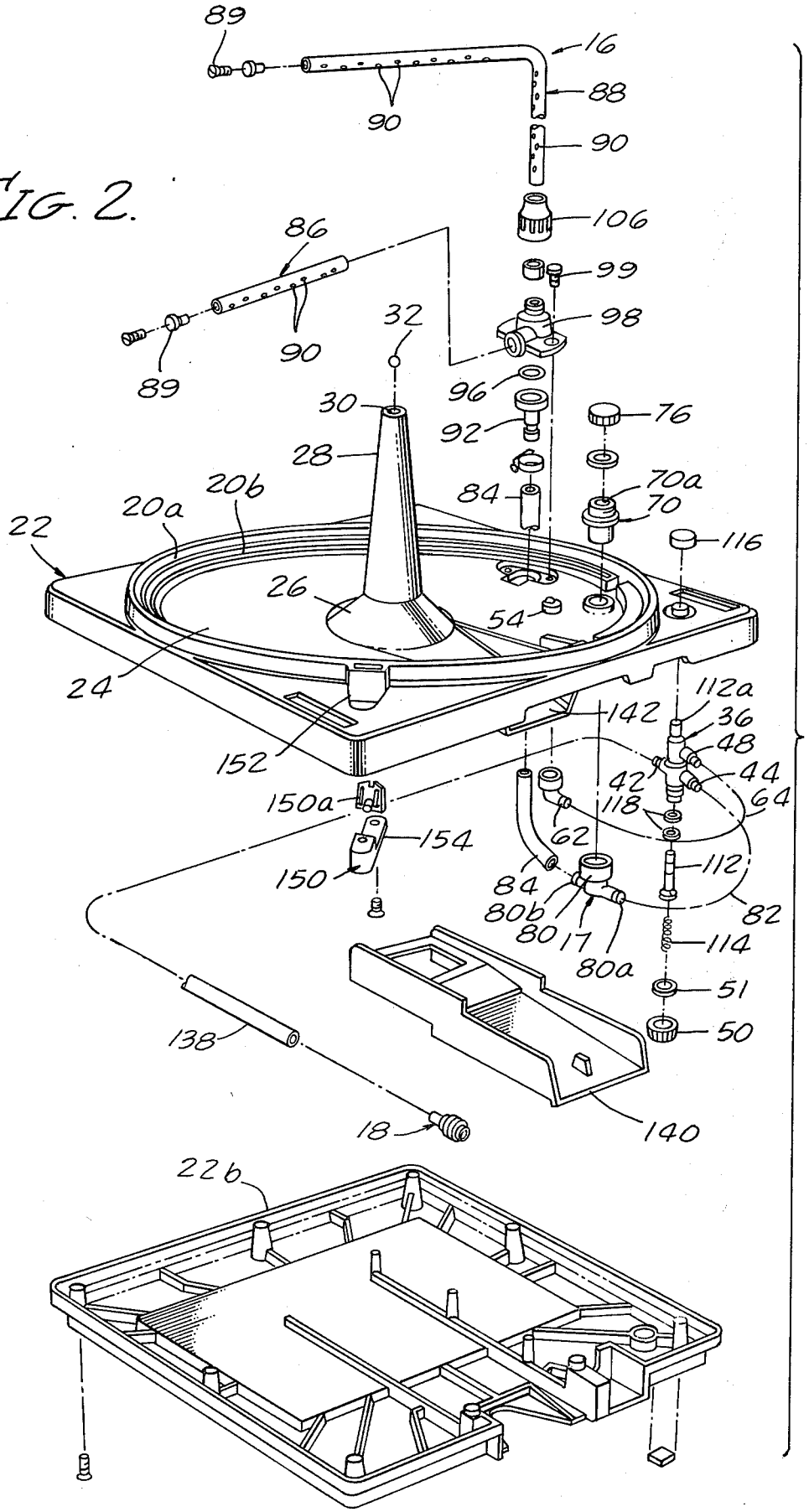
FIG. 2 is an exploded generally perspective view of the base, jet means and control means of the apparatus as they appear with the supporting rack and outer housings removed.

Referring now to the drawings and particularly to FIGS. 1, 2 and 3, the dishwasher of the present invention, generally designated in FIG. 3 by the numeral 12, includes a housing 14, a rack assemblage 15 mounted for rotation within housing 14, jet means 16 for directing a jet of water at rack assemblage 15 to impart rotational movement thereto, dosing means 17 adapted to cooperate with the jet means for dosing with an emulsifier water flowing through the jet means and flow control safety means 18 for preventing the back flow of fluid from the dishwasher toward the domestic water supply line.

As shown in FIG. 1, the housing 14 of the unit, which can suitably be constructed of thin plastic or sheet metal, comprises a first stationary part **14*a* and a rotatable part 14*b*** which comprises the closure means of the apparatus. While the housing shown in the drawings is generally cylindrical in shape, it could be constructed in other configurations to meet particular design requirements.

Referring to FIGS. 2 and 3, the housing 14 is received in concentric, circular tracks **20*a* and 20*b* formed in the upper portion 22*a* of a generally rectangular base 22. The fixed portion 14*a* of the housing is sealably received in track 20*b* while the movable portion 14*b* of the housing is received for sliding movement within track 20*a***.

As best seen in FIG. 2, track **20*b* defines the outer periphery of a floor 24 which slopes radially inwardly toward a frustoconically shaped, upwardly extending hub 26. Extending upwardly from hub 26 is a frustoconically shaped column 28 having at its upper end a recess 30 adapted to closely receive a ball bearing 32. The upper portion 22*a* of the base is affixed to a lower portion 22*b*** to form an internal cavity, the purpose of which will be presently discussed.

Turning once again to FIG. 1, rack assemblage 15 includes a rack having upper and lower circularly shaped members **15*a* and 15*b* and apertured hub portion 15*c* and 15*d*. Radiating outwardly from these hub portions are a plurality of spokes 15*e* and 15*f*. The upper and lower members 15*a* and 15*b* are maintained in a vertically spaced apart location by four supports 15*g*. Receivable with the apertures of hub portions 15*c* and 15*d* are inserts 15*h* and 15*i***. The rack is preferably constructed of coated steel wire and is specially configured to carry and strategically position various items of crockery, cutlery, dishes and cookware with the housing and in a specific relationship with respect to the spray jet means.

As shown in FIG. 3, rack assemblage 15 is rotatably supported by column 28 with insert **15*i* being disposed in close proximity with the lower portion of the column and with insert 15*h* resting upon and being rotatably supported by the ball bearing 32. With this arrangement the rack assemblage is freely rotatable with housing 14 about the central column 28**.

Also forming a part of the rack assemblage 15 is a uniquely configured silverware holder 34 comprising upper and lower members **34*a* and 34*b*. These members, which are held in a vertically spaced apart position by means of adjacent pairs of the supports 15*g*, are provided with silverware support means for positioning the silverware to be washed at a slight angle with respect to the vertical axis of the unit. More specifically, the upper member 34*a* is provided with a plurality of circumferentially spaced apart hook-like protrusions 34c which define openings therebetween adapted to receive the handle portion of the silverware. Similarly lower member 34b is provided with a plurality of circumferentially spaced apart apertures 34d, or recesses, adapted to support the opposite end of the silverware. Apertures 34c and 34d** are angularly offset so that the silverware will be maintained on an angular, or sloping, orientation during the washing operation which has been found to be optimum for an efficient scrubbing action by the water spray jets.

In the embodiment of the invention shown in the drawings, the jet means 16 comprises a first collimated jet means for directing a collimated stream of water at the rack assemblage for initiating rotation thereof and a second spray jet means for sustaining rotation of the rack assemblage once the starting inertia of the rack has been overcome by the first jet means. To control the rotation of the rack, control means is provided. This control means is cooperatively associated with the spray jet means and the collimated jet means to direct the flow of the water through the latter during the start-up operation and then through the former during the normal wash cycle.

Figure 4:
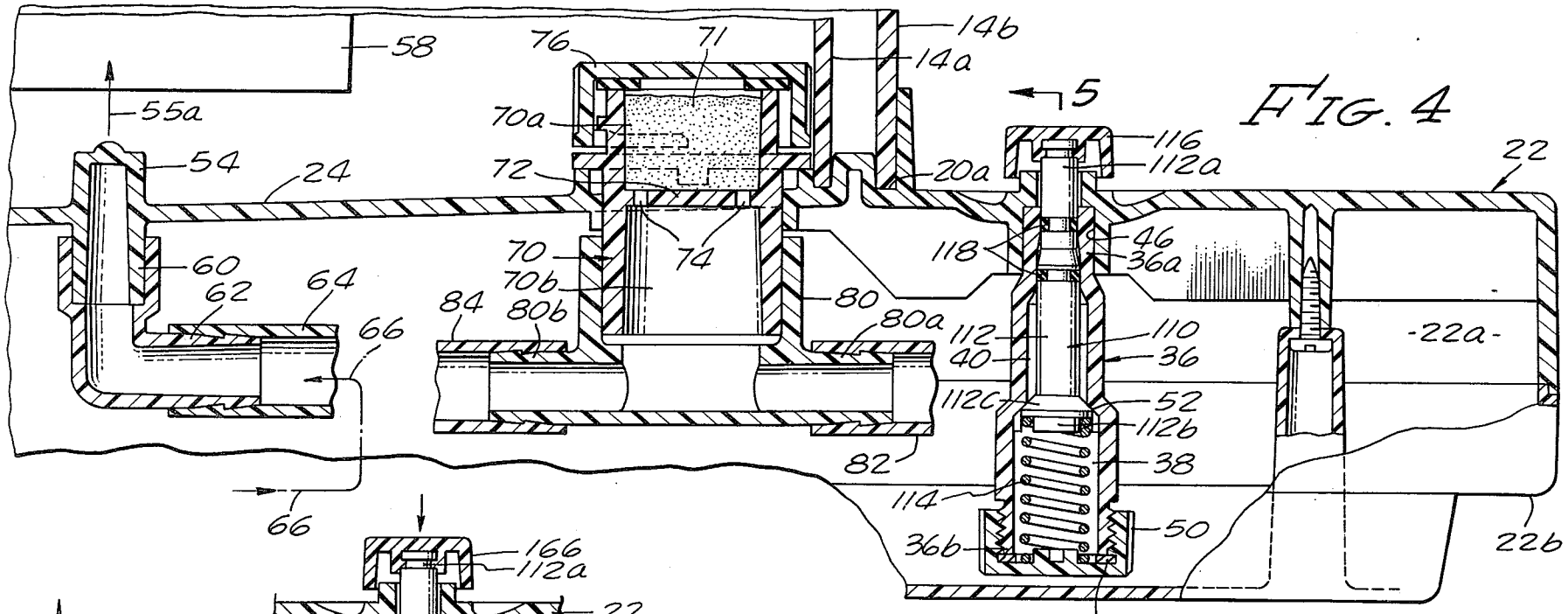
FIG. 4 is a fragmentary cross-sectional view of portions of the jet and control means of the invention showing the configuration of the first collimated jet, the dosing means and the control means for controlling the direction of flow of the water received from the domestic water line.
Figure 6:
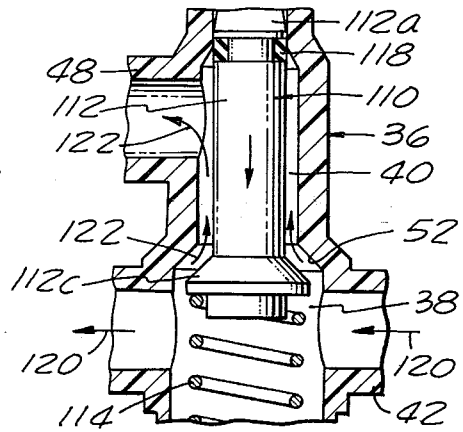
FIG. 6 is an enlarged fragmentary cross-sectional view of a portion of the control means showing it in a position which permits the flow of water toward the first collimated jet.
Figure 5:
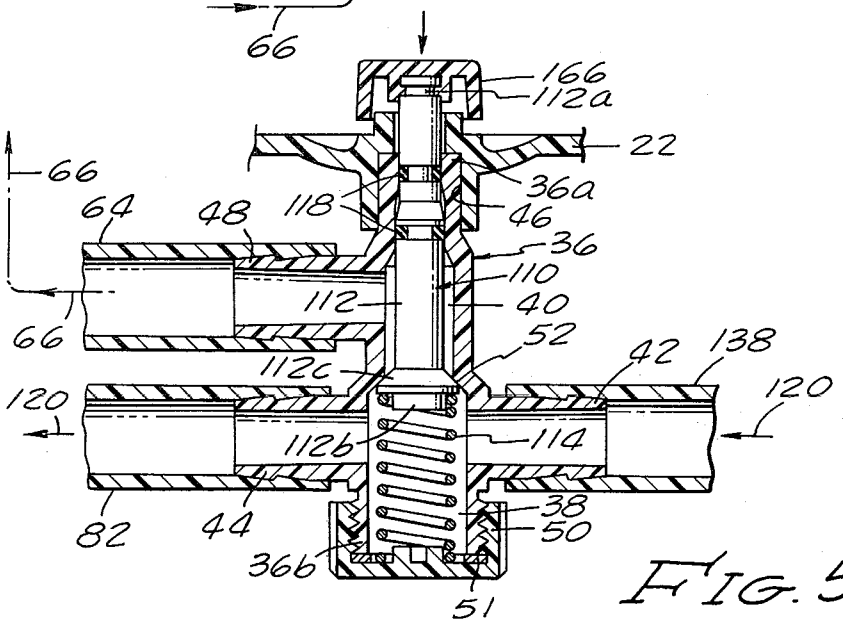
FIG. 5 is a fragmentary cross-sectional view taken along lines 5—5 of FIG. 4 showing the internal construction of the control means.

Turning to FIGS. 2, 4, 5 and 6, the jet means 16 of the invention can be seen to comprise a cylindrically shaped housing 36 defining first and second chambers 38 and 40 (FIGS. 4 and 5). Housing 36 has an inlet connection 42 leading into chamber 38 and a first outlet connection 44 leading from chamber 38. The housing is received proximate its upper and 36a within a counter bore 46 formed in base 22. Additionally, housing 36 has a second outlet connection 48 in communication with chamber 40. The lower end 36b of housing 36 is closed by a threaded cap 50 and washer 51. Formed between chambers 38 and 40 is a valve seat 52, the purpose of which will presently be described.

In the present form of the invention, the previously decribed first collimated jet means comprises an upwardly extending hollow housing 54 formed as an integral part of floor 24 of base 22 (See FIG. 3 for the relative location of housing 54 with respect to rack assemblage 15). As indicated in FIGS. 3 and 8, housing 54 is provided with a small aperture 55 proximate its upper end for directing a high presure, collimated stream of water in the direction indicated by arrow 55a toward one of a plurality of vanes 58 which depend from the lower member 15b of the rack assemblage.

Referring once again to FIGS. 4 and 5, the first collimated jet means also comprises a downwardly extending portion 60 which is integrally formed with floor 24 and which is interconnected with an inlet connection 62. This inlet connection 62 is connected by means of a fluid conduit 64 with outlet connection 48 of housing 36 so that fluid can flow in the direction of the arrows 66 in FIGS. 4 and 5.

Also forming a part of the apparatus of the present invention is the previously mentioned dosing means 17 which is adapted to cooperate with the jet means for dosing water flowing through the jet means with an emulsifier. In the present form of the invention, the dosing means comprises a housing 70, having an upper chamber 70a (FIG. 4) disposed above floor 24 and a lower chamber 70b disposed below floor 24. Chambers 70a and 70b are divided by a partition 72 and are in communication with one another via two holes 74 extending through the partition 72. Chamber 70a is closed by a cap 76 which is removably interconnected to housing 70 by any suitable means such as a bayonet-type connection means. With the cap removed a liquid or powdered soap 71 can be added to chamber 70a. Connected to the lower end of housing 70 is a coupler member 80 which has an inlet connection 80a and an outlet connection 80b. Inlet connection 80a is connected to outlet connection 44 of housing 36 by a fluid conduit 82 (FIG. 2). By means of fluid conduit 84, outlet connection 80b is, in turn, connected to the inlet of the second spray jet means, the construction of which will not be discussed.

Figures 7, 8:
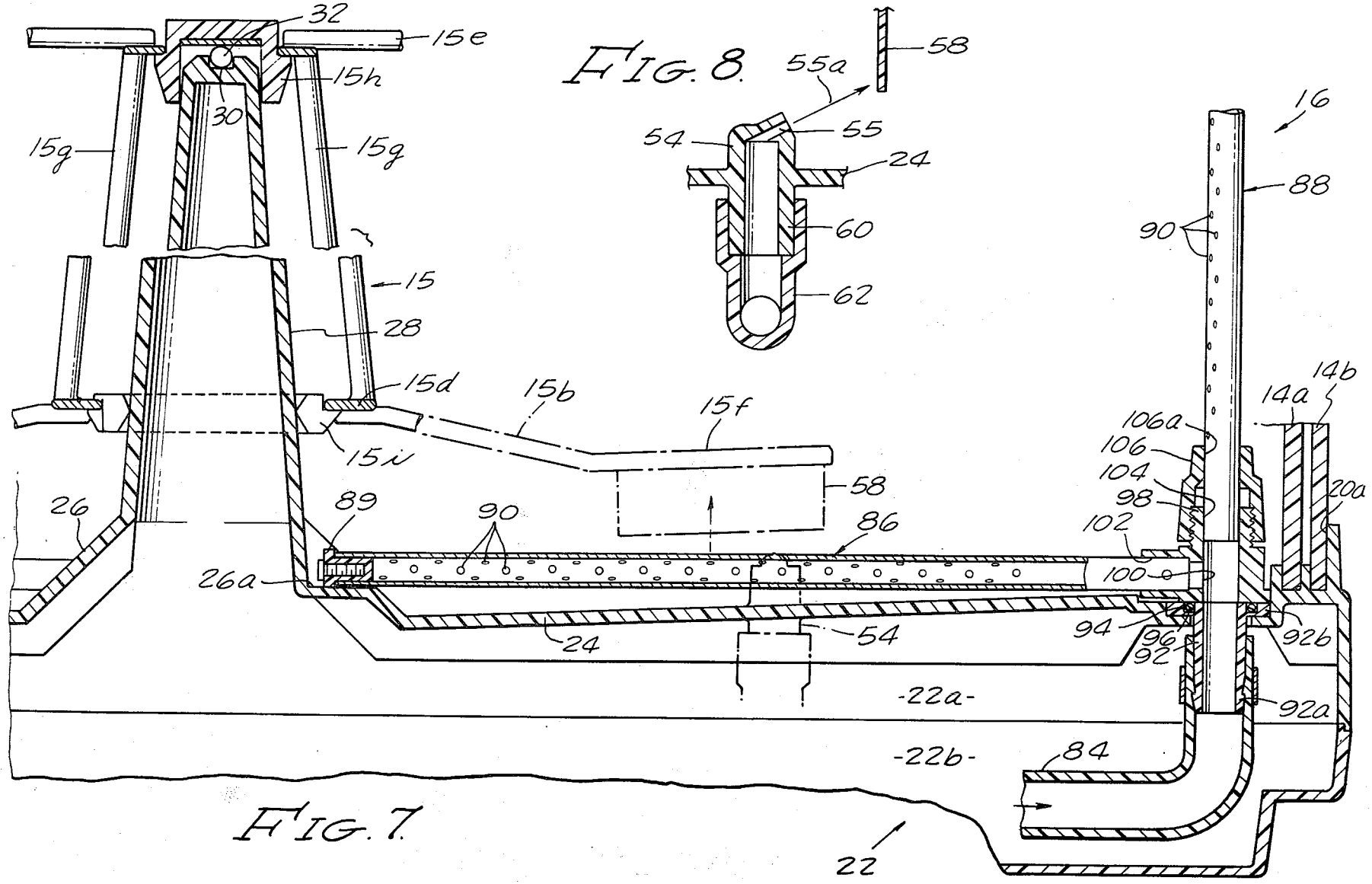
FIG. 7 is an enlarged fragmentary cross-sectional side elevational view of a portion of the apparatus illustrating the construction of the second jet spray means of the invention.
FIG. 8 is a fragmentary cross-sectional view of the first collimated jet showing the jet of water being directed toward a vane member depending from the dish supporting rack.

As best seen by referring to FIGS. 2, 3 and 7, in the present embodiment of the invention, the second spray jet means is provided in the form of a specially configured hollow tubing comprising a first substantially horizontal extending conduit leg portion 86 extending beneath rack assemblage 15, a substantially vertically extending conduit leg portion 88 disposed proximate the periphery of rack 15 (FIGS. 3 and 7). Integrally formed with leg portion 88 is substantially horizontally extending portion 88a disposed above rack 15. The inboard ends of portions 86 and 88a are closed by plug assemblages 89.

The tubing of the second spray jet means may be constructed from copper, aluminium, plastic or other suitable durable material which can be bent into the configuration shown in FIGS. 2 and 3. In FIGS. 2 and 7 it can be seen that a multiplicity of small holes 90 are drilled in a specific pattern in each of the leg portions as well as in the vertically extending portion of the tubing. The pattern of holes 90 is carefully engineered to create a three dimensional water spray pattern within housing 14 which sustains rotation of rack 15 and produces a unique scrubbing type of clensing action on the dishes and cookware supported in rack assemblage 15. The position of these holes or apertures 90 as shown in the drawings is critical to the operation of the device in that through each aperture there is directed a high velocity spray jet which impinges on the articles to be washed. The velocity of these jets coupled with the three dimensional pattern thereof creates a highly novel and unique scrubbing action upon the articles supported within rack assemblage 15.

As previously discussed, the second spray jet means is in communication with the domestic water supply via the dosing means through conduit 84 (FIG. 2) which in turn is connected at one of its ends to connector 80b. The other end of conduit 84 is connected to a connector 92 (FIGS. 2 and 7) which forms a part of the second spray jet means of the present embodiment of the invention. Connector 92 has a shank portion 92a and a flange portion 92b. Shank 92a extends through floor 24 and flange 92b is provided with a groove 94 adapted to receive a resilient O-ring 96 which is disposed in sealing engagement with the lower surface of a "T" adapter 98 which is affixed to floor 24 by threaded connectors 99 and which also forms a part of the second jet spray means.

Adapter 98 has an inlet passageway 100 in communication with connector 92, a first outlet 102 adapted to receive the inner end of leg portion 86 and a second outlet 104 adapted to rotatably receive the lower end of leg portion 88 of the spray tube. Outlet 104 is externally threaded to accommodate a closure member 106 having a throat portion 106a within which the lower end of the leg portion 88 of the spray tube is closely received. With this arrangement the spray tube can be rotated angularly with respect to the rack assemblage about its vertically extending axis by simply loosening closure member 106. In the present embodiment of the invention closure member 106 and adaptor 98 comprise the primary components of the adjustment means for adjusting the orientation of the second spray jet means. While the components are shown as threadably interconnected, other connections such as bayonet-type connections can be used. By adjusting the spray tube in the manner described, the angle at which jets of water eminating from the spray tube strike the dishes emplaced upon the rack assemblage can be precisely adjusted. This enables precise control over the speed of rotation of the rack assemblage during the washing cycle and insures an optimum scrubbing action by the jets of water striking the dishes at the most effective angle.

Referring again to FIG. 7 it is to be noted that the inboard end of leg portion 86 is supported by frustoconical portion 26*a* and in this way is at all times maintained in a spaced relationship with the sloping floor 24 and out of contact with the dishwasher as it drains toward the center of the unit. This is an important safety aspect of the apparatus which tends to insure against back flow of the dirty dishwater into the domestic water supply in the event of a drop in source water pressure.

Another extremely important aspect of the present invention resides in the unique and improved control means for controlling the flow of water between the first collimated jet means and the second jet spray means. Turning once again to FIGS. 4, 5 and 6, this control means comprises a valve assemblage carried within housing 36 and generally designated in the drawings by the numeral 110. Assemblage 110 includes a valve stem 112 having upper and lower extremities 112*a* and 112*b*. Intermediate its extremities valve stem 112 is provided with a tapered surface 112*c* adapted to sealably engage the previously identified valve seat 52 when the valve is in a closed position. To continuously urge the valve stem upwardly and into a closed position is a biasing means provided in the form of a coil spring 114 disposed within housing 36 intermedite cap 50 and the bottom of the valve stem 112.

The upper end 112*a* of the valve stem normally extends above the upper surface of base 22 when the valve is in a closed position. A cap, or push button 116 is carried by upper end 112*a* of the valve stem. Intermediate portions 112*a* and 112*c*, the valve stem is maintained in sealable engagement with the inner walls of O-rings 118.

When the valve assemblage is closed, as shown in FIG. 5, water from the domestic water supply flows, in the direction of the arrows 120, through connectors 42 and 44 and into conduit 82 which leads to the dosing means. However, when the valve is opened by depressing button 116 causing stem 112 to move downwardly so that portion 112*c* moves away from seat 52, water will be permitted to flow in the direction of the arrows 122 toward connector 48. With the valve thusly opened, water will flow through connector 48 into conduit 64 and toward the collimated jet means (see FIGS. 4 and 5). As indicated in FIG. 8, the water flowing under pressure into housing 54 will create the high velocity collimated water jet indicated by the arrow 55*a*. This water jet sequentially strikes the vanes 58 disposed at the bottom of the rack assemblage causing it and the dishes carried therein to rotate about column 28.

Once the start-up inertia of the rack assemblage is overcome, release of the button will, due to the urging of spring 114, cause the valve to move into a closed position with all of the water once again being directed toward the dosing means and thence to the second spray jet means. As previously discussed, the apertured spray tubing of the spray jet means can be adjusted as necessary to insure smooth and continuous rotation of the rack assemblage throughout the duration of the washing cycle.

Still another important feature of the presently described invention is the flow control safety means 18 provided here in the form of a vacuum breaker assemblage. As best seen by referring to FIGS. 9 and 10, this assemblage comprises a first housing 120 defining a water inlet passage 122 and a second housing 124 defining a water outlet passage 126. Housing 120 is externally threaded to mate with internal threads 124*a* provided in housing 124 and is provided with at least one vent opening 127 in communication with atmosphere.

Carried by housing 120 is coupling means for quickly connecting and disconnecting the assemblage to a domestic water supply as for example, a hot water faucet. In the present form of the invention, the coupling means comprises a collar 128 received over the outside surface of housing 120, a retaining ring 130 adapted to retain the collar in position over the housing and biasing means, in the form of spring 132, for biasing the collar in a direction toward the ring 130. Collar 128 is designed to mate with a standard, commercially available faucet adapter (not shown) which is receivable between the collar and housing 120 and is held captive therebetween by the ball bearings 131 carried about the periphery of housing 120. This arrangement enables quick connection and disconnection of the assemblage to the source of domestic hot water.

Disposed intermediate passages 122 and 126 and held securely in position between housings 120 and 124 is a closure means comprising flexible diaphragm 134 which is adapted to normally block the flow of water between passageways 122 and 126. When the diaphragm is in the closed position shown in FIG. 9, water cannot flow from passageway 122 toward passageway 126, nor can it flow in the opposite direction. As indicated by the arrows 136 in FIG. 9, water flowing within passageway 126 in a direction toward the blocking diaphragm will be automatically vented to atmosphere through openings 127.

Figure 10:
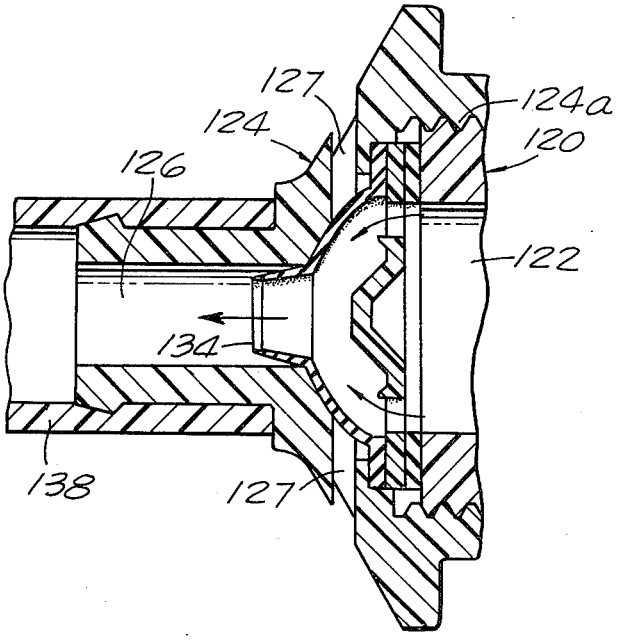
FIG. 10 is a fragmentary cross-sectional view of a portion of the fluid control safety means of FIG. 9 showing the appearance of the device in an open condition permitting the flow of fluid from the domestic water supply line toward the dishwasher unit.

Turning to FIG. 10, the flexible diaphragm 134 is specifically constructed so that when the water pressure within passageway 122 reaches a predetermined level the diaphragm will deform into the configuration shown blocking vents 127 and permitting water to flow freely toward passageway 126 and thence to the dishwasher apparatus through a conduit 138. However, should the water pressure drop below this level, the diaphragm will automatically close as shown in FIG. 9. In this way, no contaminated water from the dishwasher apparatus can ever flow into the domestic water supply lines to which the apparatus is connected.

Other important features of the improved dishwasher of the present invention include the novel, retractable drain trough 140 (FIGS. 2 and 3) which conveniently slides into and out of a guide 142 (FIG. 2) disposed within the cavity defined between the upper and lower base members 22*a* and 22*b* and the closure locking means which locks housing 14*b* in a closed position.

As best seen in FIG. 2, the guide 142 is integrally formed with floor 24 and is in communication with the washing chamber so that when trough 140 is in an extended position water will flow by force of gravity along the sloping floor 24 into the trough 140 for deposition into an adjacent sink or drain conduit. The drain trough 140 is of a capacity sufficient to adequately drain the apparatus with no fear of the water level therein rising above a safe, predetermined level.

Figure 12:
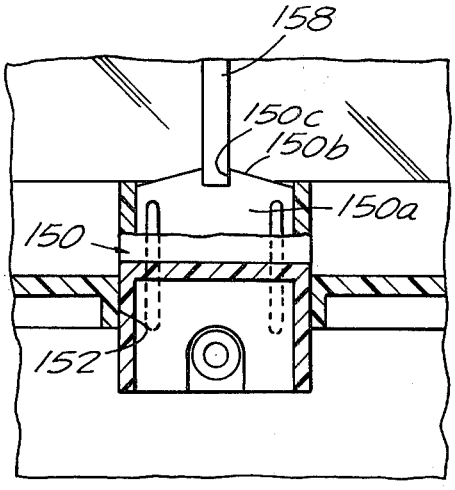
FIG. 12 is a fragmentary cross-sectional view of the locking means taken along lines 12—12 of FIG. 6.
Figure 11:
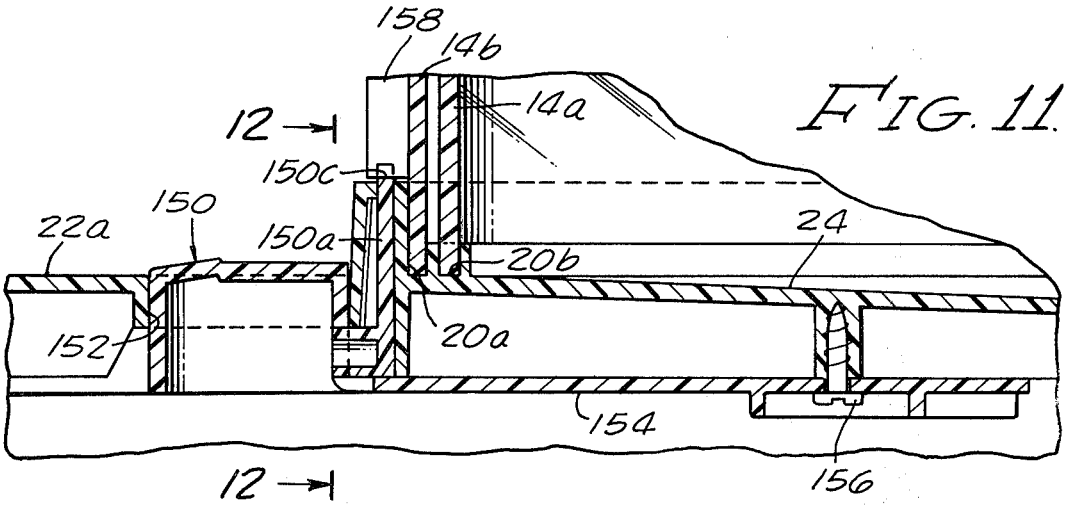
FIG. 11 is a fragmentary cross-sectional view of the locking means of the invention for locking the rotatable portion of the housing in a closed orientation.
Figure 13:
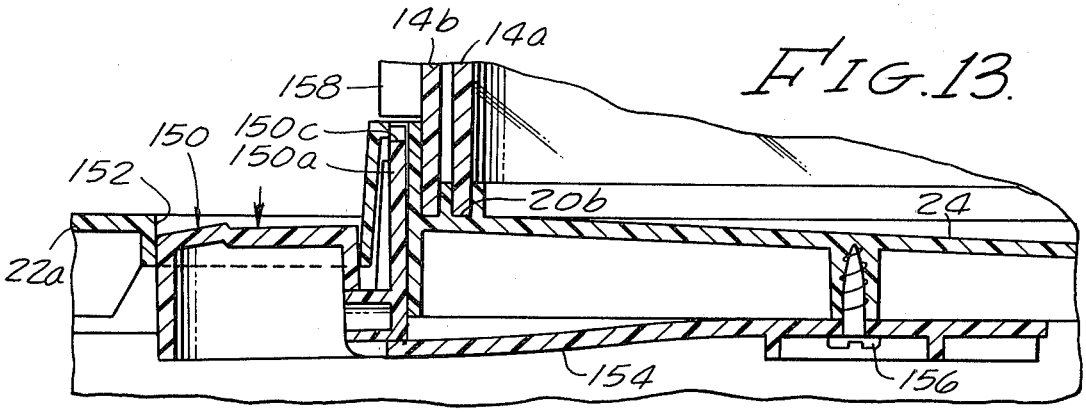
FIG. 13 is a fragmentary cross-sectional view of the locking means which is similar to FIG. 11 but showing the locking means in a depressed, release configuration to permit rotation of the rotatable portion of the housing.

Turning to FIGS. 11, 12 and 13 the novel closure locking means of the invention comprises an actuating means carried by the upper portion 22*a* of base 22. In the form of the invention shown in the drawings, the actuating means includes an actuating member 150 slidably carried within an opening 152 formed in the upper portion 22*a* of the base. Actuating member 150 can be moved as a result of pressural contact imposed thereon from a first elevated position, as shown in FIG. 11, to a second depressed position as shown in FIG. 13. A biasing means is provided for yieldably urging against movement of member 150 from the first position to the second position. In the present embodiment of the invention, this biasing means comprises a tab member 154 which is affixed to the underside of sloping floor 24 by means of a suitable connector, such as a screw 156. As illustrated in FIG. 13, a pressural force exerted downwardly on member 150 will cause tab 154 to deform downwardly in the manner shown in FIG. 13. The actuating member 150 also includes an upwardly extending member 150*a* which, as best seen in FIG. 12, has sloping side surfaces 150*b*. At the apex of these sloping surfaces 150*b*, there is provided a slot 150*c*. When actuating member 150 is in its upward position, as shown in FIG. 11, slot 150*c* is adapted to closely receive a rib member 158, formed on the external surface of the rotatable portion 14*b* of closure housing 14 (FIG. 3). However, when member 150 is depressed, as shown in FIG. 13, rib member 158 will freely pass over portion 150*a* of the actuating member.

As will be noted in FIG. 3, similarly configured rib members 160 are provided at spaced apart locations about the periphery of closure member 14*b*. Rib members 160 function as gripping handles for use by the operator of the device in easily rotating the housing 14*b* relative to fixed housing 14*a*. Rib members 160 are constructed of a height such that they will freely pass over portion 150*a* of the actuating member even when said member is in its elevated position. However, when rib member 158 is moved into the position shown in FIG. 3, the sloping side portions 150*b* of the actuating member will permit the rib to depress the actuating member so that the lower end of rib 158 can be received in a locking position within slot 150*c*. In this locking position, rotatable closure member 14*b* cannot be opened unless and until actuating member 150 is depressed into the position shown in FIG. 13. In this position, the rotatable portion of the closure housing can be freely rotated into an open position so that the dishes and silverware can be introduced into or removed from the rack assemblage 15.

Operation

In operating the apparatus of the embodiment of the invention shown in the drawings, the entire unit may be conveniently placed on a sink cabinet with the trough 140 being movable into the extended position shown in FIG. 3 overhanging the sink portion of the sink cabinet. In this position, water flowing from the interior of the unit along trough 140 will be safely deposited into the sink for drainage through the drain lines attached to the sink unit itself. With the assemblage in position on the sink cabinet, or drainage board, safety connector 18 may be interconnected with the hot water faucet of the sink unit.

Once the dishwasher apparatus is interconnected with the hot water line of the domestic supply and the drain trough is extended in the manner shown in FIG. 3, actuating member 150 of the locking means can be depressed and the rotatable portion of the closure housing 14 rotated to an open position. In this open position free and convenient access to the rack assemblage 15 is provided. The dishes and silverware to be washed can then be placed on the rack assemblage and are strategically supported thereon by the structrual elements of the assemblage so that continued rotation of the rack by the spray jet means will be assured after start-up inertia has been overcome by the collimated jet means.

Once the dishes and silverware have been loaded into the dishwasher apparatus, the rotatable portion of the closure housing can be moved into a closed position with rib 158 being received within the slot provided in the actuating means 150. When the rotatable portion of the closure housing is disposed in this locked position, the unit will be entirely watertight and the only water coming from the unit will be water draining through drain trough 140 into the sink.

With the closure housing in the closed position, the hot water faucet may be turned on, causing water to flow into the apparatus through conduit 138. By depressing member 116 of the control means, the water flowing through conduit 138 will be diverted so as to flow through conduit 64 toward the collimated jet means of the apparatus. This will cause a high pressure collimated jet of water to be emitted from the collimated jet means in a direction toward the vanes 58 which depend from the lower portion of the rack assembly (FIG. 8). This high pressure collimated stream of water will overcome the inertia of the rack assembly causing it to start to rotate. Once rotation has been achieved, push button 116 can be released and water will be caused to flow through conduit 82 toward the jet spray means of the apparatus via the dosing means or assemblage 17. As the water flows through the dosing means, the detergent contained therein will be metered into the stream of water and will flow along with the water into the jet spray means.

Because of the unique arrangement and construction of the spray jet means of the invention, the water jets emitting from apertures 90 will impact the dishes carried on rack assemblage 15*a* in such a manner as to continue the constant rate of rotation of the rack assemblage. At the same time the unique design of the spray jet means will insure a highly efficient scrubbing action to efficiently and quickly remove food particles from the dishes carried on the rack assemblage. Should the operator desire to increase or decrease the speed of rotation of the rack assemblage, this may be accomplished by adjustment of the upper portion 88 of the spray jet meanscan be readily accomplished by simply loosening member 106, and then rotating the upper portion of the jet spray means to change the angular orientation of the leg 88*a* with respect to the top of the rack assemblage. Once the desired orientation of leg 88*a* is achieved, member 106 can be retightened, thus locking the spray jet means in the selected optimum position.

After the dishes have been cleaned by the action of the spray jet means, the hot water faucet can be closed and the apparatus can be opened by simply depressing the actuating member 150 and rotating closure housing 14b into an open position allowing easy access to the clean dishes residing on the rack assemblage.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A dishwasher, comprising:

(a) a base;

(b) a closure housing carried by said base;

(c) a rack rotatably mounted within said housing, said rack being adapted to support articles to be washed;

(d) jet means for directing a jet of water in the direction of said rack to impart rotational movement thereto, said jet means comprising:

(1) a first collimated jet means for emitting a collimated stream of water in the direction of said rack for initiating rotation of said rack; and (2) a second spray jet means for sustaining rotation of said rack; said means comprising a first conduit extending beneath said rack, a second generally vertically extending conduit and a third conduit interconnected with said second conduit and extending above said rack, said second and third conduits being angularly adjustable relative to said rack;

(3) control means for controllably and simultaneously regulating the flow of water between said first collmated jet means and said second spray jet means whereby a stream of water can be directed at said rack with sufficient velocity to initiate rotation thereof; and (e) drain means carried by said base and extending externally of said housing for draining water from the interior of said housing to the exterior thereof.

2. A dishwasher as defined in claim 1 in which said jet means further comprises a generally cylindrically shaped valve housing carried by said base externally of said closure housing, said valve housing having:

(a) a water inlet;

(b) a first water outlet connected to said spray jet means;

(c) a second water outlet connected to said collimated jet means; and (d) an internal valve seat disposed between said water inlet and said second water outlet.

3. A dishwasher as defined in claim 2 in which said control means comprises a valve assemblage carried within said valve housing, said valve assemblage comprising:

(a) a valve stem having upper and lower extremities, said valve stem being movable from a first position to a second position and including a tapered surface located intermediate its extremities, said tapered surface being adapted to sealably engage said internal valve seat when said valve stem is in a first position; and (b) biasing means for yieldably urging against movement of said valve stem from a first to a second position.

4. A dishwasher as defined in claim 1 in which said closure housing comprises a first fixed portion mounted on said base and a second movable portion carried by said base and rotatable with respect to said first portion.

5. A dishwasher as defined in claim 4 including releasable locking means for locking said second portion against rotation.

6. A dishwasher as defined in claim 5 in which said releasable locking means comprises:

(a) an actuating means carried by said base, said means including:

(1) an actuating member carried by said base and movable from a first elevated position to a second depressed position, said actuating member having a slot formed therein;

(2) bias means for yieldably urging against movement of said actuating member from said first position to said second position; and (b) at least one locking rib carried by said second movable portion of said housing said locking rib being receivable in the slot formed in said actuating member when said member is in a first elevated position.

7. A dishwasher as defined in claim 1 including adapter means for connecting said dishwasher to a source of water under pressure and flow control safety means for permitting flow of water under pressure in a first direction from said source of water toward the rotatable dishwasher but preventing flow of water in an opposite direction.

8. A dishwasher as defined in claim 7 in which said flow control safety means comprises:

(a) a first housing defining a water inlet passageway;

(b) connector means carried by said first housing for interconnecting said first housing with said adapter means whereby water will flow into said water inlet passageway;

(c) a second housing defining a water outlet pasageway adapted to be interconnected with the rotatable dishwasher; and (d) closure means disposed intermediate said inlet and said outlet for normally preventing flow of water therebetween, said closure means being operable to allow the flow of water into said outlet upon the pressure of the water in said inlet passageway reaching a predetermined level.

9. A dishwasher, comprising:

(a) a base;

(b) a closure housing carried by said base;

(c) a rack rotatably mounted within said housing, said rack being adapted to support articles to be washed;

(d) jet means for directing a jet of water in the direction of said rack to impart rotational movement thereto, said jet means comprising:

(1) a first collimated jet means for emitting a collimated stream of water in the direction of said rack for initiating rotation of said rack; and (2) a second spray jet means for sustaining rotation of said rack; said means comprising a first conduit extending beneath said rack, a second generally vertically extending conduit and a third conduit interconnected with said second conduit and extending above said rack, said second and third conduits being angularly adjustable relative to said rack;

(3) generally cylindrically shaped valve housing carried by said base externally of said closure housing, said valve housing having:
(i) a water inlet;
(ii) a first water outlet connected to said spray jet means;
(iii) a second water outlet connected to said collimated jet means; and
(iv) an internal valve seat disposed between said water inlet and said second water outlet;

(4) control means for controllably and simultaneously regulating the flow of water between said first collimated jet means and said second spray jet means whereby a stream of water can be directed at said rack with sufficient velocity to initiate rotation thereof, said control means comprising a valve assemblage carried within said valve housing, said valve assemblage comprising:
(i) a valve stem having upper and lower extremities, said valve stem being movable from a first position to a second position and including a tapered surface located intermediate its extremities, said tapered surface being adapted to sealably engage said internal valve seat when said valve stem is in a first position; and
(ii) biasing means for yieldably urging against movement of said valve stem from a first to a second position.

10. A dishwasher as defined in claim 9 in which said closure housing comprises a first fixed portion mounted on said base and a second movable portion carried by said base and rotatable with respect to said first portion and in which said dishwasher further comprises releasable locking means for locking said second portion against rotation.

11. A dishwasher as defined in claim 10 including adapter means for connecting said dishwasher to a source of water under pressure and flow control safety means for permitting flow of water under pressure in a first direction from said source of water toward the rotatable dishwasher but preventing flow of water in an opposite direction.

12. A dishwasher adapted to be operably interconnected with a source of water under pressure, comprising:
(a) a base;
(b) a closure housing carried by said base said closure housing comprising a first fixed portion mounted on said base and a second movable portion carried by said base and rotatable with respect to said first portion;
(c) releasable locking means for locking said second portion of said closure housing against rotation;
(d) a rack rotatably mounted within said housing, said rack being adapted to support articles to be washed; and
(e) jet means for directing a jet of water in the direction of said rack to impart rotational movement thereto, said jet means comprising:
(1) a first collimated jet means for emitting a collimated stream of water in the direction of said rack for initiating rotation of said rack; and
(2) a second spray jet means for sustaining rotation of said rack; said means comprising a first conduit extending beneath said rack, a second generally vertically extending conduit and a third conduit interconnected with said second conduit and extending above said rack, said second and third conduits being angularly adjustable relative to said rack;
(3) a generally cylindrically shaped valve housing carried by said base externally of said closure housing, said valve housing having:
(i) a water inlet;
(ii) a first water outlet connected to said spray jet means;
(iii) a second water outlet connected to said collimated jet means; and
(iv) an internal valve seat disposed between said water inlet and said second water outlet;
(4) control means for controllably and simultaneously regulating the flow of water between said first collimated jet means and said second spray jet means whereby a stream of water can be directed at said rack with sufficient velocity to initiate rotation thereof, said control means comprising a valve assemblage carried within said valve housing, said valve assemblage comprising:
(i) a valve stem having upper and lower extremities, said valve stem being movable from a first position to a second position and including a tapered surface located intermediate its extremities, said tapered surface being adapted to sealably engage said internal valve seat when said valve stem is in a first position; and
(ii) biasing means for yieldably urging against movement of said valve stem from a first to a second position;
(f) flow control safety means for permitting flow of water under pressure in a first direction from said source of water toward said water inlet of said valve housing, but preventing flow of water in an opposite direction; and
(g) drain means carried by said base and extending externally of said housing for draining water from the interior of said housing to the exterior thereof.

* * * * *